US011337879B2

(12) United States Patent
Shuch et al.

(10) Patent No.: US 11,337,879 B2
(45) Date of Patent: May 24, 2022

(54) SOFT WEARABLE ROBOTIC DEVICE TO TREAT PLANTAR FLEXION CONTRACTURES

(71) Applicant: ARIZONA BOARD OF REGENTS ON BEHALF OF ARIZONA STATE UNIVERSITY, Scottsdale, AZ (US)

(72) Inventors: Benjamin Shuch, Phoenix, AZ (US); Chaitanya Kulkarni, Tempe, AZ (US); Sudhanshu Katarey, Tempe, AZ (US); Harshit Dangaich, Phoenix, AZ (US); Saivimal Sridar, Mesa, AZ (US); Pham Huy Nguyen, Mesa, AZ (US); Thomas Sugar, Chandler, AZ (US)

(73) Assignee: Arizona Board of Regents on behalf of Arizona State University, Scottsdale, AZ (US)

( * ) Notice: Subject to any disclaimer, the term of this patent is extended or adjusted under 35 U.S.C. 154(b) by 135 days.

(21) Appl. No.: 16/856,935

(22) Filed: Apr. 23, 2020

(65) Prior Publication Data

US 2020/0337931 A1 Oct. 29, 2020

Related U.S. Application Data

(60) Provisional application No. 62/838,714, filed on Apr. 25, 2019.

(51) Int. Cl.
*A61H 1/02* (2006.01)
*A61H 9/00* (2006.01)

(52) U.S. Cl.
CPC ..... *A61H 1/0266* (2013.01); *A61H 9/0092* (2013.01); *A61H 2201/0103* (2013.01);
(Continued)

(58) Field of Classification Search
CPC ..... A61H 1/0266; A61H 9/0092; A61H 2205/125; A61H 2201/0103;
(Continued)

(56) References Cited

U.S. PATENT DOCUMENTS 5,722,919 A 3/1998 Timmer
6,010,468 A * 1/2000 Grove ..... A61H 9/0078 601/23
(Continued)

FOREIGN PATENT DOCUMENTS

CA 2441261 C 9/2007
CN 101568318 B 7/2012
(Continued)

OTHER PUBLICATIONS

Brockett, C. et al., "Biomechanics of the ankle", Orthopaedics and Trauma, Jun. 2016, vol. 30, No. 3, pp. 232-238 <10.1016/j.mporth.2016.04.015>.
(Continued)

*Primary Examiner* — Kendra D Carter
*Assistant Examiner* — Arielle Wolff
(74) *Attorney, Agent, or Firm* — Snell & Wilmer L.L.P.

(57) ABSTRACT

An orthosis for increasing a range of motion of an ankle is disclosed. In various embodiments, the orthosis includes a frame including a ball shell and a heel shell; a first actuator disposed on the ball shell and configured to apply a first force against a ball region of a foot, resulting in a moment being applied at the ankle; and a first rod connecting the heel shell and the ball shell, the first rod being slidably connected to at least one of the heel shell or the ball shell. In various embodiments, a second actuator is disposed on the heel shell and configured to apply a second force against a heel region
(Continued)

of the foot. In various embodiments, a calf shell is configured to support a calf region of a leg that is connected to the ankle.

11 Claims, 4 Drawing Sheets

(52) U.S. Cl.
CPC ..... *A61H 2201/165* (2013.01); *A61H 2201/1642* (2013.01); *A61H 2205/106* (2013.01); *A61H 2205/125* (2013.01)

(58) Field of Classification Search
CPC ..... A61H 2205/106; A61H 2201/165; A61H 2201/1642; A61H 9/0078; A61H 2201/1238; A61H 2205/12; A61H 2201/5007; A61H 1/00; A61H 3/00; A61H 3/08; A61H 2003/001–007; B25J 9/0006
See application file for complete search history.

(56) References Cited

U.S. PATENT DOCUMENTS

| | | | | |
|---|---|---|---|---|
| 6,277,057 | B1 | 8/2001 | Hayden | |
| 7,399,258 | B1 | 7/2008 | Sugar et al. | |
| 8,287,477 | B1 | 10/2012 | Herr et al. | |
| 9,192,487 | B2 | 11/2015 | Flaven et al. | |
| 9,308,642 | B2 | 4/2016 | Sugar et al. | |
| 10,123,897 | B2 | 11/2018 | Sutti et al. | |
| 2003/0153857 | A1* | 8/2003 | McCarthy | A61F 5/012 602/27 |
| 2005/0107725 | A1* | 5/2005 | Wild | A61H 9/0078 601/152 |
| 2017/0165095 | A1* | 6/2017 | Romo | A61F 5/0113 |
| 2020/0337597 | A1 | 10/2020 | Sugar et al. | |
| 2020/0337933 | A1 | 10/2020 | Sugar et al. | |
| 2020/0337937 | A1 | 10/2020 | Sugar et al. | |
| 2021/0069050 | A1* | 3/2021 | Welsh | A61H 9/0078 |

FOREIGN PATENT DOCUMENTS

| | | | |
|---|---|---|---|
| WO | 2004096083 | A2 | 11/2004 |
| WO | 2004096905 | A2 | 11/2004 |
| WO | 2008041554 | A1 | 4/2008 |

OTHER PUBLICATIONS

Park, Y. et al., "Bio-inspired active soft orthotic device for ankle foot pathologies", 2011 IEEE/RSJ International Conference on Intelligent Robots and Systems (Sep. 25-30, 2011, San Francisco, CA, USA), 2011, pp. 4488-4495 <DOI:10.1109/IROS.2011,6094933>.

Singer, B. et al., "Incidence of ankle contracture after moderate to severe acquired brain injury", Archives of Physical Medicine and Rehabilitation, Sep. 2004, vol. 85, No. 9, pp. 1465-1469 <DOI:10.1016/j.apmr.2003.08.103>.

* cited by examiner

SOFT WEARABLE ROBOTIC DEVICE TO TREAT PLANTAR FLEXION CONTRACTURES

CROSS-REFERENCE TO RELATED APPLICATION

This application is a non-provisional of, and claims priority to and the benefit of, U.S. Provisional Application No. 62/838,714 entitled "SOFT WEARABLE ROBOTIC DEVICE TO TREAT PLANTAR FLEXION CONTRACTURES" filed on Apr. 25, 2019, which is hereby incorporated by reference in its entirety (except for any subject matter disclaimers or disavowals, and except to the extent of any conflict with the disclosure of the present application, in which case the disclosure of the present application shall control).

TECHNICAL FIELD

The present disclosure relates generally to soft robotic systems and, more particularly, to systems for treating plantar flexion contractures.

BACKGROUND

A human body typically comprises a variety of joints that are configured to operate in a variety of ways. The range of motion of a joint (e.g., an ankle) depends upon the anatomy of the joint. Typically, a joint is moveable in two directions—flexion and extension. Flexion occurs when the joint bends, while extension occurs when the joint straightens. An ankle, for example, exhibits plantar flexion, where the ankle or foot bend downward, and dorsiflexion, where the ankle or foot bend upward. An ankle also exhibits inversion and eversion as well.

When a joint is injured, either by trauma or by surgery, scar tissue can form, often resulting in flexion or extension contractures. Such conditions may limit the range of motion of the joint—e.g., limiting flexion (in the case of an extension contracture) or extension (in the case of a flexion contracture). A contracture of the ankle, for example, is a condition in which the muscles, ligaments, tendons or other connective tissue that cause or permit the ankle to flex are shortened or tightened, resulting in decreased mobility and range of motion of the ankle. This condition is often the result of a person not moving the joint over a long period of time, such as may occur, for example, if the ankle is immobilized in a cast. Other causes of contracture include genetic disorders involving the connective tissues of the body or traumatic brain injuries or stroke.

It is possible to treat flexion contractures through use of a range-of-motion (ROM) orthosis. ROM orthoses are devices commonly used during physical rehabilitative therapy to increase the range-of-motion over which the patient can flex or extend the joint. Commercially available ROM orthoses are typically attached on opposite members of the joint and apply a torque to rotate the joint in opposition to the contraction. The force is gradually increased to increase the working range or angle of joint motion.

SUMMARY

An orthosis for increasing a range of motion of an ankle is disclosed. In various embodiments, the orthosis includes a frame including a ball shell and a heel shell; a first actuator disposed on the ball shell and configured to apply a first force against a ball region of a foot, resulting in a moment being applied at the ankle; and a first rod connecting the heel shell and the ball shell, the first rod being slidably connected to at least one of the heel shell or the ball shell. In various embodiments, a second actuator is disposed on the heel shell and configured to apply a second force against a heel region of the foot.

In various embodiments, a calf shell is configured to support a calf region of a leg that is connected to the ankle. In various embodiments, the calf shell is connected to the heel shell via a second rod. In various embodiments, the second rod is slidably connected to at least one of the heel shell or the calf shell.

In various embodiments, a heel restraint is configured to restrain the heel region of the foot against the heel shell. In various embodiments, the heel restraint comprises a first strap attached to a first side of the heel shell and a second strap attached to a second side of the heel shell. In various embodiments, the heel restraint comprises a hook and loop fastener configured to adjustably connect the first strap to the second strap. In various embodiments, a calf restraint is configured to restrain the calf region of the leg against the calf shell.

An orthosis for treating a plantar flexion contracture of an ankle is disclosed. In various embodiments, the orthosis includes a frame including a ball shell, a heel shell and a calf shell; a first actuator disposed on the ball shell and configured to apply a first force against a ball region of a foot, resulting in a moment being applied at the ankle; and a first rod configured to slidably connect the ball shell to the heel shell.

In various embodiments, the first actuator comprises a first inflatable bladder configured for connection to a source of compressed gas. In various embodiments, a second actuator is disposed on the heel shell and configured to apply a second force against a heel region of the foot. In various embodiments, the second actuator comprises a second inflatable bladder configured for connection to the source of compressed gas. In various embodiments, the calf shell is slidably connected to the heel shell via a second rod.

In various embodiments, the orthosis further includes a heel restraint configured to restrain a heel region of the foot against the heel shell. In various embodiments, the heel restraint comprises a first strap attached to a first side of the heel shell and a second strap attached to a second side of the heel shell. In various embodiments, the heel restraint comprises a hook and loop fastener configured to adjustably connect the first strap to the second strap.

A method for treating a plantar flexion contracture of an ankle of a foot is disclosed. In various embodiments, the method includes the steps of restraining the foot in a frame having a ball shell, a heel shell and a calf shell; and actuating a first actuator disposed on the ball shell and configured to apply a first force against a ball region of the foot, resulting in a moment being applied at the ankle. In various embodiments, the method further includes actuating a second actuator disposed on the heel shell and configured to apply a second force against a heel region of the foot.

The foregoing features and elements may be combined in various combinations and without exclusivity, unless expressly indicated herein otherwise. These features and elements as well as the operation of the disclosed embodiments will become more apparent in light of the following description and accompanying drawings. The contents of this section are intended as a simplified introduction to the disclosure, and are not intended to be used to limit the scope of any claim.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the following detailed description and claims in connection with the following drawings. While the drawings illustrate various embodiments employing the principles described herein, the drawings do not limit the scope of the claims.

DETAILED DESCRIPTION

The following detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that changes may be made without departing from the scope of the disclosure. Thus, the detailed description herein is presented for purposes of illustration only and not of limitation. Furthermore, any reference to singular includes plural embodiments, and any reference to more than one component or step may include a singular embodiment or step. Also, any reference to attached, fixed, connected, or the like may include permanent, removable, temporary, partial, full or any other possible attachment option. Additionally, any reference to without contact (or similar phrases) may also include reduced contact or minimal contact. It should also be understood that unless specifically stated otherwise, references to "a," "an" or "the" may include one or more than one and that reference to an item in the singular may also include the item in the plural. Further, all ranges may include upper and lower values and all ranges and ratio limits disclosed herein may be combined.

For the sake of brevity, conventional techniques for soft robotic systems, wearable robotics, physical therapy or the like may not be described in detail herein. Furthermore, the connecting lines shown in various figures contained herein are intended to represent exemplary functional relationships or physical couplings between various elements. It should be noted that many alternative or additional functional relationships or physical connections may be present in a practical system or method for use or construction thereof.

With reference now to the drawings, the following disclosure presents in various exemplary embodiments a wearable, soft and inflatable actuator device to treat plantar flexion contractures, such as may result, for example, from a traumatic brain injury, an acquired brain injury, or a stroke. A primary goal of the device is to provide a prolonged plantar flexion stretch at the ankle through application of a moment or torque about the ankle, which, in various embodiments, may be created through application of a force on the ball of the foot or, in various embodiments, on both the ball of the foot and on the heel. Multiple design concepts were explored in the process of determining a safe and reliable way to overcome the force of the contracture. The model that the device is based on is one that uses one or two forces to create a force couple that reduces the chance of injuring the ankle. The soft and inflatable actuators disclosed herein provide a more flexible and conformable platform for the force or forces to be applied than traditional motor and spring actuators allow.

Figure 1:
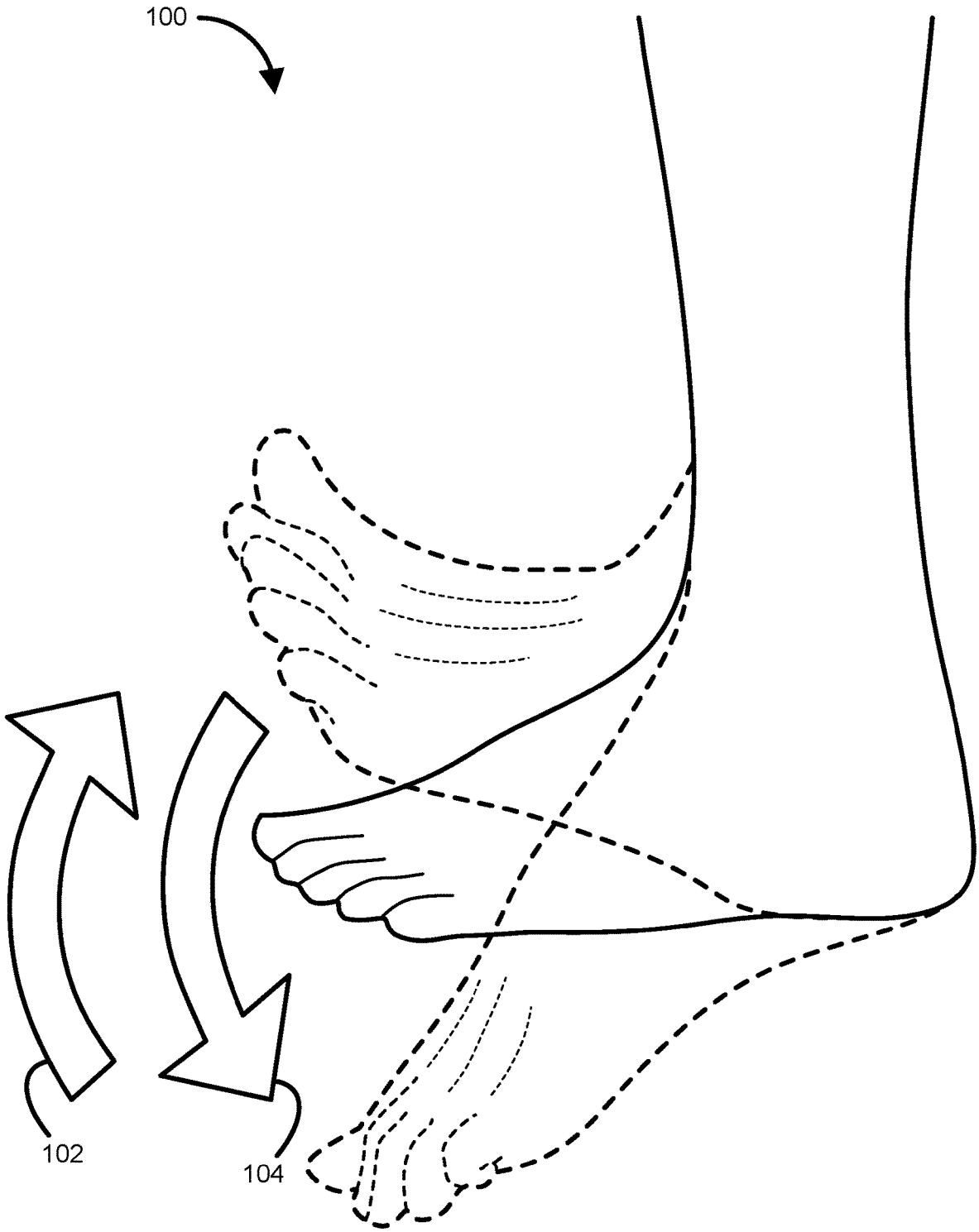
FIG. 1 provides a schematic illustration of a foot experiencing a state of dorsiflexion, where the ankle bends upward, and plantar flexion, where the ankle bends downward, in accordance with various embodiments.

A traumatic brain injury or stroke can cause a condition known as a contracture. When the condition occurs in a calf muscle, it is known as a plantar flexion contracture. Referring to FIG. 1, for example, an ankle 100 is illustrated in a state of dorsiflexion 102, where the ankle bends upward, and plantar flexion 104, where the ankle bends downward. In a plantar flexion contracture, the ankle remains in a plantar flexed state that the patient cannot control. This makes it difficult for the patient to walk and move with a normal gait cycle. The condition is common after traumatic brain injuries or strokes because the muscle tendon can become shorter, gain increased passive resistance and become more spastic. The condition may also occur because of immobilization or comas. Ankle or plantar flexion contractures are relatively common among brain trauma victims. In craniocerebral traumas, for example, contractures in the ankle were seen 76% of the time in one study. Another study showed that out of one-hundred five cases of acquired brain injuries, 16.2% suffered from contractures of the ankle.

Figure 2A:
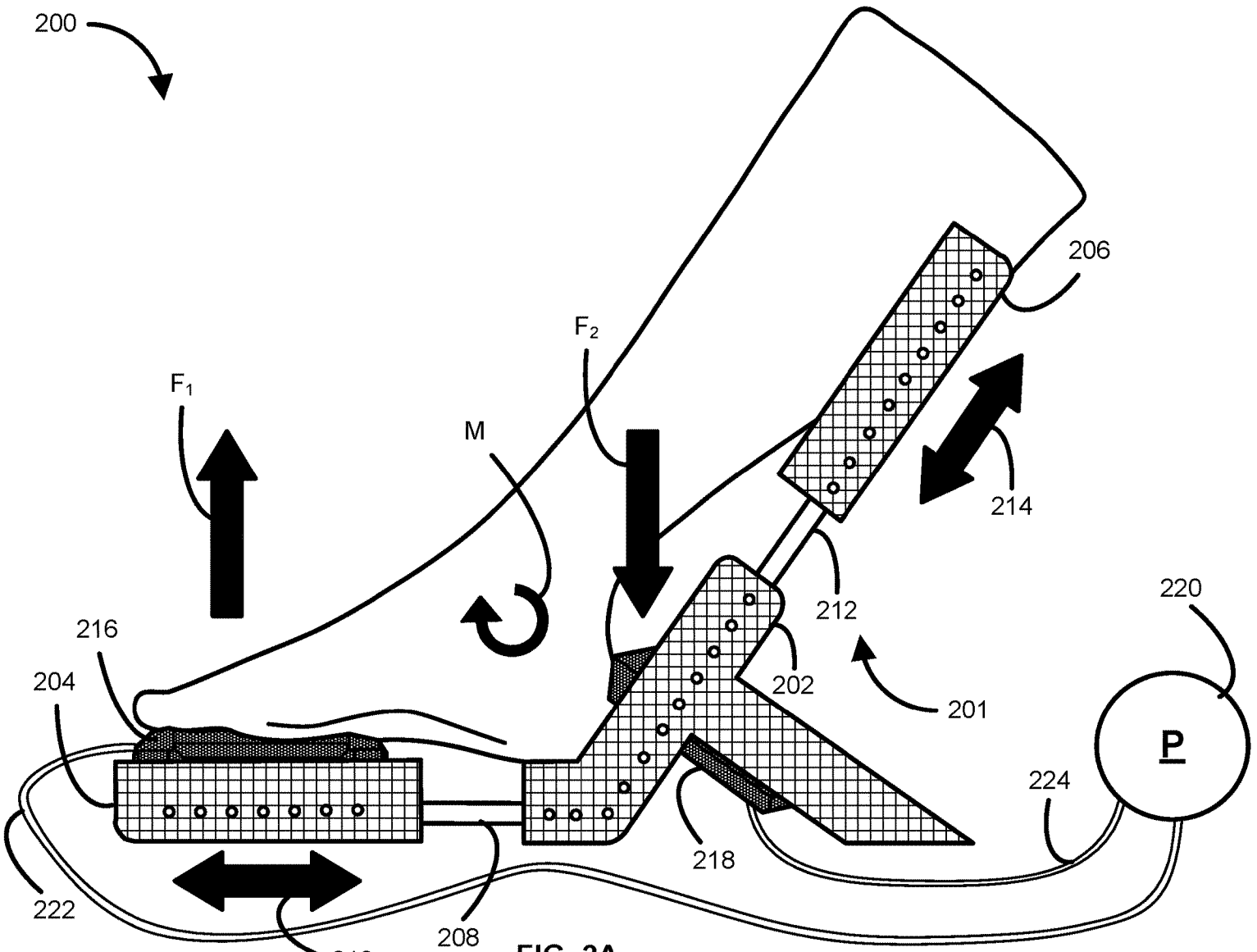
FIGS. 2A and 2B provide schematic illustrations of an orthosis, in accordance with various embodiments.
Figure 2B:
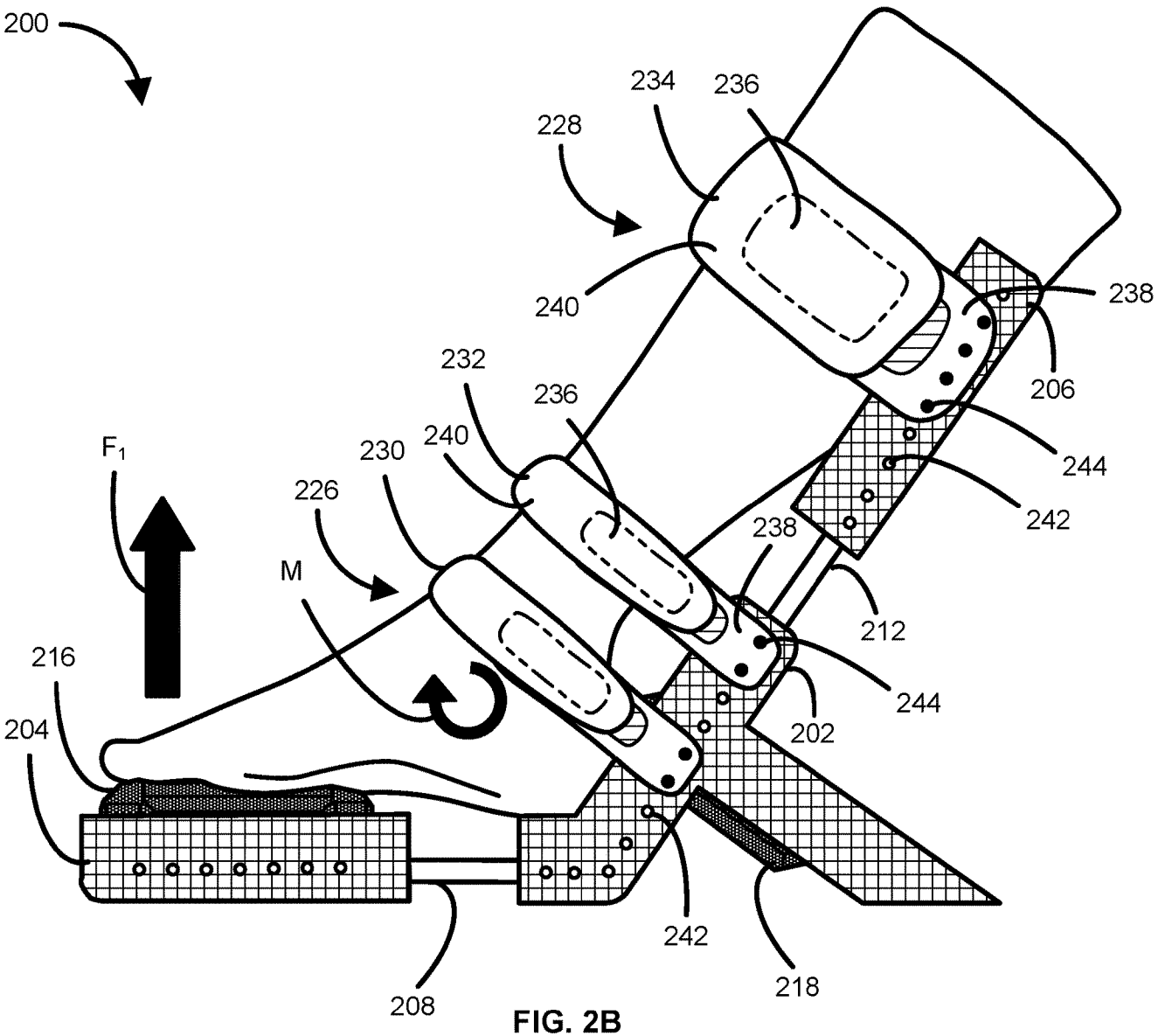

Referring now to FIGS. 2A and 2B, an orthosis 200 for treating ankle or plantar flexion contractures is illustrated. In various embodiments, the orthosis 200 includes an adjustable frame 201 comprising a heel shell 202, a ball shell 204 and a calf shell 206. The heel shell 202 is configured to receive and support a heel or a heel region of a foot, the ball shell 204 is configured to receive and support a ball or a ball region of the foot, and the calf shell 206 is configured to receive and support a calf or a calf region of a leg connected to the foot. In various embodiments, each of the heel shell 202, the ball shell 204 and the calf shell 206 may be fabricated relatively inexpensively using an additive manufacturing or three-dimensional printing process. In various embodiments, the ball shell 204 is adjustable with respect to the heel shell 202 in order for the orthosis 200 to accept a variety of foot sizes. For example, a first rod 208 (or a first plurality of rods) is disposed between the heel shell 202 and the ball shell 204. In various embodiments, the first rod 208 includes a first end fixedly or slidably attached to the heel shell 202 and a second end fixedly or slidably attached to the ball shell 204 (where one end of the first rod 208 is typically fixedly attached while the other end is typically slidably attached), thereby enabling the ball shell 204 to translate back and forth in a first direction 210 to adjust the orthosis 200 depending on the size of the foot of a user. Similarly, a second rod 212 (or a second plurality of rods) is disposed between the heel shell 202 and the calf shell 206. In various embodiments, the second rod 212 includes a first end fixedly or slidably attached to the heel shell 202 and a second end fixedly or slidably attached to the calf shell 206 (where one end of the second rod 212 is typically fixedly attached while the other end is typically slidably attached), thereby enabling the calf shell 206 to translate back and forth in a second direction 214 to adjust the orthosis 200 depending on the length of the leg of a user. In various embodiments, the rods may be fabricated from metal, which provides light weight and structural integrity and robustness for the adjustable frame 201. The metal may be aluminum stock, aluminum alloy, magnesium, magnesium alloy, stainless steel, steel, steel alloy, titanium, titanium alloy, or any combination of these. In some embodiments, the rods may be fabricated from plastic. The plastic may be high density polyethylene, polycarbonate, nylon or any other plastic with comparable material properties. In various embodiments, the rods may be cylindrical. For clarity, and in various embodiments, fixedly attached or connected refers to a first component being attached or connected to a second component in a manner such that the first component is not readily moveable in relation to the second component, while slidably attached or connected refers to a first component being attached or connected to a second component in a manner such that the first component is moveable (e.g., in translation) in relation to the second component.

In various embodiments, the orthosis 200 includes a first actuator 216 and a second actuator 218. The first actuator 216 is positioned on or connected to the ball shell 204 and is configured to create a first force $F_1$ that urges the ball of the foot upward and away from the ball shell 204. The second actuator 218 is positioned on or connected to the heel shell 202 and is configured to create a second force $F_2$ that urges the heel of the foot downward and into the heel shell 202 (though a component of the second force may also push the heel of the foot in a direction toward the ball shell 204). The result of the first force $F_1$ and the second force $F_2$ is a moment M that tends to urge an ankle experiencing a plantar flexion contracture toward a state of dorsiflexion in order to counter the plantar flexion contracture (as illustrated in FIG. 1). In various embodiments, the first actuator 216 comprises a first inflatable bladder connected to a source of compressed gas, such as, for example, a tank 220, via a first air supply tube 222. Similarly, the second actuator 218 comprises a second inflatable bladder connected to the source of compressed gas via a second air supply tube 224. In various embodiments, the first actuator 216 and the second actuator 218 are constructed using heat sealable materials, such as, for example, a nylon fabric coated with a thermoplastic polyurethane (TPU nylon). The TPU nylon material provides for inflatable bladders that are soft and conformable to the contours of the foot and capable of withstanding typical operating pressures of ten to fifteen pounds per square inch (10-15 psi) when inflated. In various embodiments, the actuators are inflated using the compressed gas and employ a nozzle with a nut and an O-ring washer to keep air from escaping. In various embodiments, the actuators may be secured into the heel shell 202 and the ball shell 204 following assembly of the adjustable frame 201 via screws or a suitable adhesive.

Referring now to FIG. 2B, the orthosis 200 may include a heel restraint 226 and a calf restraint 228. In various embodiments, the heel restraint 226 may include one or more straps, such as, for example, a first heel strap 230 and a second heel strap 232. Similarly, the calf restraint 228 may include one or more straps, such as, for example, a calf strap 234. In various embodiments, the one or more heel straps and the one or more calf straps may comprise an adjustable fastener to accommodate different sized feet and calves. In various embodiments, the adjustable fastener may include, for example, a hook and loop fastener 236 configured to fasten a first strap 238 attached to a first side of either the heel shell 202 or the calf shell 206 to a second strap 240 attached to a second side of the heel shell 202 or the calf shell 206. Other adjustable fasteners may include, for example, belt buckle fasteners or snap fasteners. In various embodiments, a plurality of threaded apertures 242 may be spaced along the first side and the second side of one or both of the heel shell 202 and the calf shell 206 to enable the various components of the heel restraint 226 and the calf restraint 228 (e.g., the first strap 238 and the second strap 240) to be positioned at different locations on the shells to better accommodate different sized feet. Each of the plurality of threaded apertures 242 may be configured to receive a threaded screw 244 (or a plurality of threaded screws) to secure the restraint to the corresponding shell. In various embodiments, the heel restraint 226 functions to secure the heel of a user's foot to the heel shell 202 while the first actuator 216 is actuated—e.g., inflated with compressed gas. As described above, activating the first actuator 216 creates the first force $F_1$ that urges the ball of the foot upward and away from the ball shell 204. With the heel of the foot secured by the heel restraint 226, the first force $F_1$ generates the moment M that tends to urge an ankle experiencing a plantar flexion contracture toward a state of dorsiflexion in order to counter the plantar flexion contracture.

In various embodiments, the orthosis 200 is used by placing a user's leg and foot onto the adjustable frame 201, and then actuating (e.g., inflating using compressed gas) the first actuator 216 and the second actuator 218. In various embodiments, prior to inflation of the actuators, the user's leg and foot are restrained in the adjustable frame 201. Where the leg and foot are restrained in the adjustable frame 201, it is not always necessary to actuate or inflate the second actuator 218, as the heel is restrained within the heel shell 202 and immobilized against the force $F_1$ provided by the first actuator 216. In various embodiments, one or both of the actuators are inflated to create a deflection at the ankle. While the pressure within the actuators increases, the deflection of ankle tends to increase, thereby countering the plantar flexion contracture. The actuator or actuators are then deflated and, ideally, the plantar flexion contracture is reduced. In various embodiments, the steps described above provide for a method for treating a plantar flexion contracture of an ankle of a foot. The method comprises a first step of restraining the foot in a frame having a ball shell, a heel shell and a calf shell. A second step comprises actuating a first actuator disposed on the ball shell and configured to apply a first force against a ball region of the foot, resulting in a moment being applied at the ankle. In various embodiments, a third step comprises actuating a second actuator disposed on the heel shell and configured to apply a second force against a heel region of the foot.

The method of treating the plantar flexion contracture (as described above) is to increase the range of motion that the ankle may flex. Any improvements made to the ROM using the method tend to be permanent, so if the orthosis 200 is able to successfully increase the ROM of the ankle, then it can help treat the plantar flexion contracture. The range of motion of a normal ankle is between 65-75 degrees, with 40-55 degrees being in plantar flexion and 10-20 degrees being in dorsiflexion. To increase the ROM, a prolonged stretch of the ankle is created by the orthosis 200 to reduce spasticity and stiffness. In various embodiments, the process may occur over a period of between one day to one week. Current treatments for plantar flexion contractures may involve the use of serial casts made from custom fiberglass shells, and using adjustable splints or orthoses bought off the market. In one specific case, a load of about 120 Newtons was applied to the ball of a patient's foot, and the serial cast was then attached. This creates between about 12 to about 16.8 Newton-meters of torque. However, serial casting can cause pressure wounds to form on different parts of the foot because of the constant pressure placed on specific areas, and once these wounds occur the patient may no longer be given another serial cast. Splints have also been used successfully to counter plantar flexion contractures, but are known to be difficult to use consistently, and may not always be used in cases of more serious contractures.

In various embodiments, the orthosis 200 described above is relatively inexpensive to fabricate, as it uses 3D printing filament, aluminum rods, Velcro® and TPU nylon (each of which may be purchased in bulk). The orthosis 200 uses actuators, unlike serial casts and splints. The orthosis 200 is able to create the necessary forces to counter the contracture and may also create a range of motion at least equal to other solutions. The orthosis 200 may also be reused unlike a serial cast, and has a quick device-ON and device-OFF time of about two minutes or less. Further, the simplicity of the orthosis 200 will enable most users to place the device on themselves, which is not common with splints and serial casts. The device also takes advantage of a force couple (e.g., the moment M) at the ankle, which reduces the reactant torque caused by the ankle making it safer to use.

Figure 3:
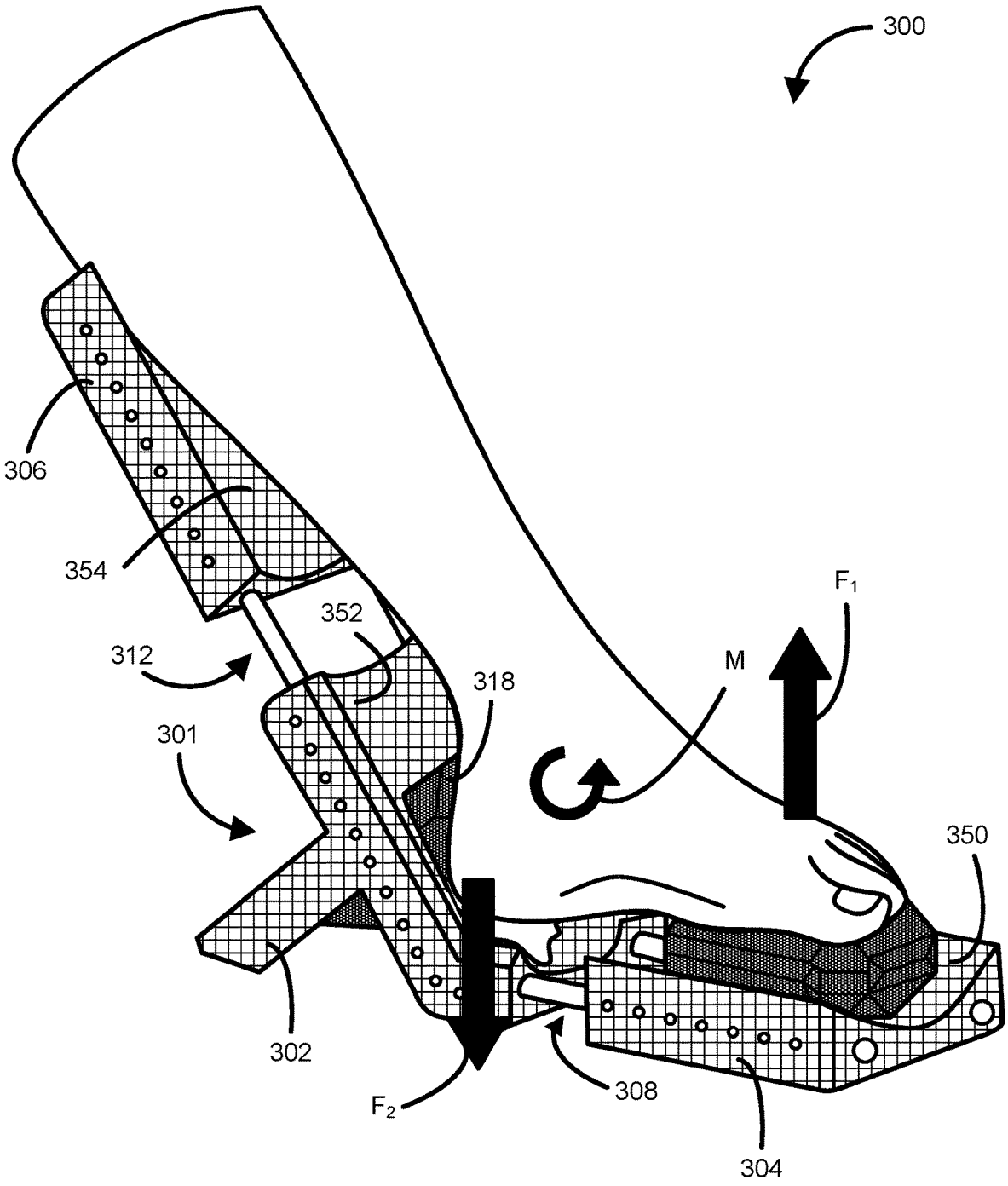
FIG. 3 provides a schematic illustration of an orthosis, in accordance with various embodiments.

Referring now to FIG. 3, an orthosis 300 for treating ankle or plantar flexion contractures is illustrated. The orthosis 300 is similar to the orthosis 200 described above, but illustrates additional features not described above. In various embodiments, the orthosis 300 includes an adjustable frame 301 comprising a heel shell 302, a ball shell 304 and a calf shell 306. The ball shell 304 includes a ball contour 350 (or a cut out region of the ball shell) that is configured to receive and support a first actuator 316 (e.g., a first inflatable bladder) that is configured to apply a first force $F_1$ against a ball or a ball region of the foot. The heel shell 302 includes a heel contour 352 (or a cut out region of the heel shell) that is configured to receive and support a second actuator 318 (e.g., a second inflatable bladder) that is configured to apply a second force $F_2$ against a heel or a heel region of the foot. The result of the first force $F_1$ and the second force $F_2$ is a moment M that tends to urge an ankle experiencing a plantar flexion contracture toward a state of dorsiflexion in order to counter the plantar flexion contracture (as illustrated in FIG. 1). In various embodiments, the calf shell 306 also includes a calf contour 354 (or a cut out region of the calf shell) that is configured to receive and support a calf or a calf region of a leg connected to the foot. Also illustrated in FIG. 3 is a first plurality of rods 308 configured to slidably connect the ball shell 304 to the heel shell 302 and a second plurality of rods 312 configured to slidably connect the calf shell 306 to the heel shell 302. In various embodiments, the constructional and operational features of the orthosis 200 described above with reference to FIGS. 2A and 2B are equally applicable to the orthosis 300 and so are not repeated here.

Benefits, other advantages, and solutions to problems have been described herein with regard to specific embodiments. Furthermore, the connecting lines shown in the various figures contained herein are intended to represent exemplary functional relationships or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

In various embodiments, system program instructions or controller instructions may be loaded onto a tangible, non-transitory, computer-readable medium (also referred to herein as a tangible, non-transitory, memory) having instructions stored thereon that, in response to execution by a controller, cause the controller to perform various operations. The term "non-transitory" is to be understood to remove only propagating transitory signals per se from the claim scope and does not relinquish rights to all standard computer-readable media that are not only propagating transitory signals per se. Stated another way, the meaning of the term "non-transitory computer-readable medium" and "non-transitory computer-readable storage medium" should be construed to exclude only those types of transitory computer-readable media that were found by In Re Nuijten to fall outside the scope of patentable subject matter under 35 U.S.C. § 101.

Numbers, percentages, or other values stated herein are intended to include that value, and also other values that are about or approximately equal to the stated value, as would be appreciated by one of ordinary skill in the art encompassed by various embodiments of the present disclosure. A stated value should therefore be interpreted broadly enough to encompass values that are at least close enough to the stated value to perform a desired function or achieve a desired result. The stated values include at least the variation to be expected in a suitable industrial process, and may include values that are within 10%, within 5%, within 1%, within 0.1%, or within 0.01% of a stated value. Additionally, the terms "substantially," "about" or "approximately" as used herein represent an amount close to the stated amount that still performs a desired function or achieves a desired result. For example, the term "substantially," "about" or "approximately" may refer to an amount that is within 10% of, within 5% of, within 1% of, within 0.1% of, and within 0.01% of a stated amount or value.

Furthermore, no element, component, or method step in the present disclosure is intended to be dedicated to the public regardless of whether the element, component, or method step is explicitly recited in the claims. No claim element herein is to be construed under the provisions of 35

U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

Finally, it should be understood that any of the above described concepts can be used alone or in combination with any or all of the other above described concepts. Although various embodiments have been disclosed and described, one of ordinary skill in this art would recognize that certain modifications would come within the scope of this disclosure. Accordingly, the description is not intended to be exhaustive or to limit the principles described or illustrated herein to any precise form. Many modifications and variations are possible in light of the above teaching.

What is claimed is:

1. An orthosis for increasing a range of motion of an ankle, comprising:

a frame including a ball shell, a calf shell, and a heel shell;

a first inflatable actuator disposed on top of the ball shell and configured to apply a first force against a ball region of a foot, wherein the first force urges the ball region of the foot upward and away from the ball shell, resulting in a moment being applied at the ankle;

a second inflatable actuator coupled to the heel shell and configured to apply a second force against a heel region of the foot, wherein the second force urges the heel region of the foot downward and into the heel shell;

a first cylindrical rod connecting the heel shell and the ball shell, the first cylindrical rod being slidably connected to at least one of the heel shell or the ball shell; and a second cylindrical rod connecting the heel shell and the calf shell, the second cylindrical rod being slidably connected to at least one of the heel shell or the calf shell.

2. The orthosis of claim 1, wherein the calf shell is configured to support a calf region of a leg that is connected to the ankle.

3. The orthosis of claim 2, further comprising a heel restraint configured to restrain the heel region of the foot against the heel shell.

4. The orthosis of claim 3, wherein the heel restraint comprises a first strap attached to a first side of the heel shell and a second strap attached to a second side of the heel shell.

5. The orthosis of claim 4, wherein the heel restraint comprises a hook and loop fastener configured to adjustably connect the first strap to the second strap.

6. The orthosis of claim 5, further comprising a calf restraint configured to restrain the calf region of the leg against the calf shell.

7. The orthosis of claim 1, wherein the first inflatable actuator comprises a first inflatable bladder configured for connection to a source of compressed gas.

8. The orthosis of claim 7, wherein the second inflatable actuator comprises a second inflatable bladder configured for connection to the source of compressed gas.

9. The orthosis of claim 8, wherein the first inflatable actuator and the second inflatable actuator are independently inflatable.

10. The orthosis of claim 1, wherein the first cylindrical rod is configured to permit the ball shell to translate back and forth along a first direction, and wherein the second cylindrical rod is configured to permit the calf shell to translate back and forth along a second direction different than the first direction.

11. A method for treating an ankle of a foot, comprising:

restraining the foot in an orthosis; and actuating a first inflatable actuator of the orthosis to apply a first force against a ball region of the foot; and actuating a second inflatable actuator of the orthosis to apply a second force against a heel region of the foot, wherein the first force and the second force result in a moment being applied at the ankle, wherein the orthosis comprises:

a frame including a ball shell, a calf shell, and a heel shell;

the first inflatable actuator disposed on top of the ball shell and configured to apply the first force against a ball region of a foot, wherein the first force urges the ball region of the foot upward and away from the ball shell;

the second inflatable actuator coupled to the heel shell and configured to apply the second force against the heel region of the foot, wherein the second force urges the heel region of the foot downward and into the heel shell;

a first cylindrical rod connecting the heel shell and the ball shell, the first cylindrical rod being slidably connected to at least one of the heel shell or the ball shell; and a second cylindrical rod connecting the heel shell and the calf shell, the second cylindrical rod being slidably connected to at least one of the heel shell or the calf shell.

* * * * *